United States Patent [19]

Gary

[11] Patent Number: 5,021,935

[45] Date of Patent: Jun. 4, 1991

[54] DECORATIVE LIGHT SHADE

[75] Inventor: Lonnie F. Gary, Lubbock, Tex.

[73] Assignee: Gary Products Group, Inc., Lubbock, Tex.

[21] Appl. No.: 430,774

[22] Filed: Nov. 2, 1989

[51] Int. Cl.[5] ..... F21V 3/00

[52] U.S. Cl. ..... 362/237; 362/249; 362/255; 362/360; 362/368; 362/806

[58] Field of Search ..... 362/122, 123, 237, 249, 362/252, 255, 806, 809, 368, 360, 391, 407, 433

[56] References Cited

U.S. PATENT DOCUMENTS

| | | | |
|---|---|---|---|
| 2,714,652 | 8/1955 | Meyer | 362/249 |
| 3,011,049 | 11/1961 | Kinghorn | 362/249 |
| 3,050,619 | 8/1962 | Abramson | 362/255 |
| 3,253,137 | 5/1966 | Richter, III | 362/249 |
| 4,234,915 | 11/1980 | Malenowski et al. | 362/391 |
| 4,425,602 | 1/1984 | Lansing | 362/360 |
| 4,574,339 | 3/1986 | Stine | 362/360 |
| 4,667,276 | 5/1987 | Cheng | 362/249 |
| 4,682,079 | 7/1987 | Sanders et al. | 362/806 |
| 4,763,232 | 8/1988 | Woodside | 362/391 |
| 4,833,580 | 5/1989 | Allen | 362/806 |

*Primary Examiner*—Ira S. Lazarus
*Assistant Examiner*—Sue Hagarman
*Attorney, Agent, or Firm*—Ross, Howison, Clapp & Korn

[57] ABSTRACT

A decorative light shade assembly comprising first and second releasably engageable shade sections injection molded from a polymeric material. At least one of the shade sections further comprises means for receiving a decorative bulb and socket assembly and means for frictionally engaging the electrical conductor connected to the decorative bulb and socket assembly for suspending the decorative light shade from the decorative light string. The use of molded apertures for directing light outwardly from the subject decorative light shade is also disclosed.

10 Claims, 2 Drawing Sheets

DECORATIVE LIGHT SHADE

BACKGROUND OF THE INVENTION

1. Field of the Invention

This invention relates to decorative lights, and more particularly, to molded plastic decorative light shades adapted for use with conventional decorative light strings comprising a plurality of decorative bulb and socket assemblies connected by a common electrical conductor to an electrical outlet or power supply.

2. Description of the Prior Art

The use of illuminated globes or shades in decorative lighting adapted to be suspended over patios, walkways, backyards, and the like, is well known. Such globes or shades can be fabricated from various materials ranging, for example, from relatively inexpensive paper and balsa wood creations up to very expensive and ornate lanterns made of glass and metal. In recent years, blow molded plastic globes or shades have become very popular for use in decorating for holidays, special occasions, parties, and other such events where the use of festive, brightly colored, overhead lighting is desired. Such lighting is typically installed and used for a relatively short period of time and then taken down and stored for use at a subsequent time.

Decorative light shades comprising blow molded plastic shades or globes have proved to be quite desirable for use in decorative patio lighting because of the broad range of colors in which the plastic resins are available, their translucence and the good strength-to-weight ratio of the plastic resins when molded into shapes having relatively thin cross-sections. Unfortunately, however, because such plastic shades or globes have been blow molded in the past, their use requires the shipment and storage of significant volumes of air, which is economically disadvantageous to the manufacturer, retailer and consumer. Another disadvantage that has been experienced with blow molded plastic shades or globes for use in decorative patio lighting has arisen from certain limitations in the blow molding process that restrict the geometry of the shapes and patterns which can be molded effectively. Also, many of the conventional, commercially available decorative light shades are not suitable for use with the decorative light strings comprising C7 or C9 decorative bulb and socket assemblies.

Accordingly, a polymeric decorative light shade is needed that can be quickly and efficiently used with and suspended from a light source comprising conventional, commercially available decorative light strings, that can be quickly and conveniently assembled and disassembled to permit shipping and storage in a significantly smaller volume than that required by the fully assembled shade or globe, and that can be injection molded in a broad range of designs and configurations.

SUMMARY OF THE INVENTION

According to the present invention, a decorative light shade is provided comprising releasably interlocking first and second shade portions that are desirably injection molded from a polymeric resin, and which can be conveniently assembled and disassembled at the use site.

According to one preferred embodiment of the invention, the first and second shade portions of the decorative lights are fabricated so as to occupy significantly less volume when disassembled than when assembled.

According to another preferred embodiment of the invention, the subject decorative light shades are adapted to utilize conventional, commercially available light strings comprising size C7 or size C9 decorative bulb and socket assemblies.

According to another embodiment of the invention, a decorative light shade is provided that comprises a series of cooperating slots, passageways, and an aperture adapted to facilitate the attachment and detachment of the subject decorative light shade to a decorative light string.

According to another embodiment of the invention, a decorative light shade is provided that comprises at least one aperture adapted to cast light downwardly or outwardly.

BRIEF DESCRIPTION OF DRAWINGS

The decorative light shade of the invention is further described and explained in relation to the following figures of the Drawing wherein.

Like numerals are used to indicate like parts in all figures of the drawings.

DESCRIPTION OF THE PREFERRED EMBODIMENTS

Figure 1:
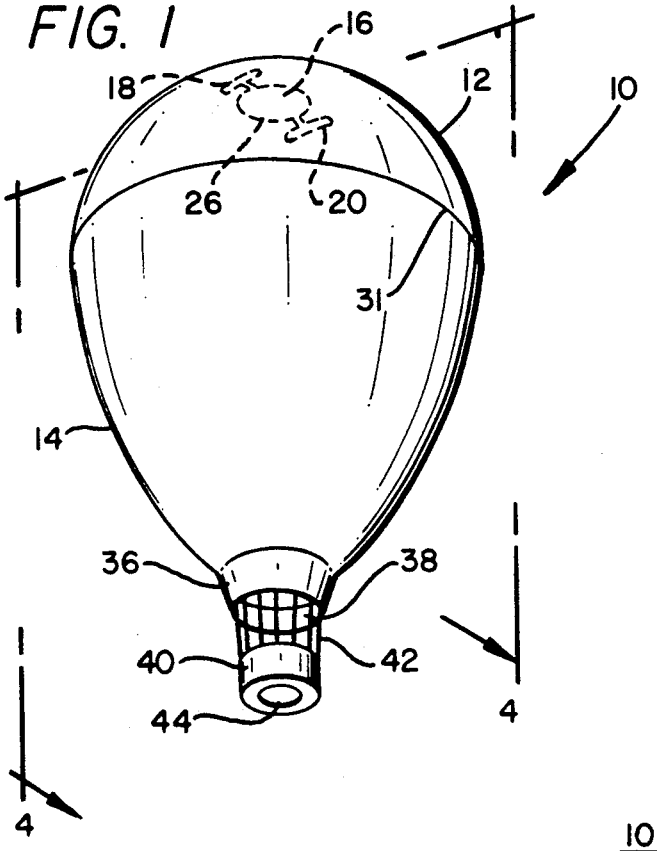
FIG. 1 is a perspective view depicting one preferred embodiment of the decorative light shade of the invention.

FIG. 1 is a perspective view of a preferred embodiment of decorative shade assembly 10. Decorative shade assembly 10 preferably comprises upper section 12 and lower section 14, each of which is preferably injection molded from a polymeric resin selected from the many moldable resins that are commercially available and well known to those of ordinary skill in the art. Upper section 12 and lower section 14 are preferably releasably joined at seam 31 by a circumferentially extending snap-lock joint further described below in relation to FIG. 4. While upper section 12 and lower section 14 of decorative shade assembly 10 as disclosed herein are illustrated herein as molded for decorative purposes in the configuration of a hot-air balloon, it is understood that numerous other shapes and configurations can also be molded within the structural and functional constraints of the subject invention.

It is preferred, however, that decorative shade assemblies 10 made in accordance with the present invention comprise upper and lower sections which can be nested or otherwise packed when disassembled so as to occupy substantially less volume when disassembled than when assembled. This aspect of the subject invention is believed to constitute a significant improvement over the previously known, blow molded decorative shades that cannot be disassembled so as to reduce the total volume required for shipping, display and storage by manufacturers, retailers and consumers.

Figure 2:
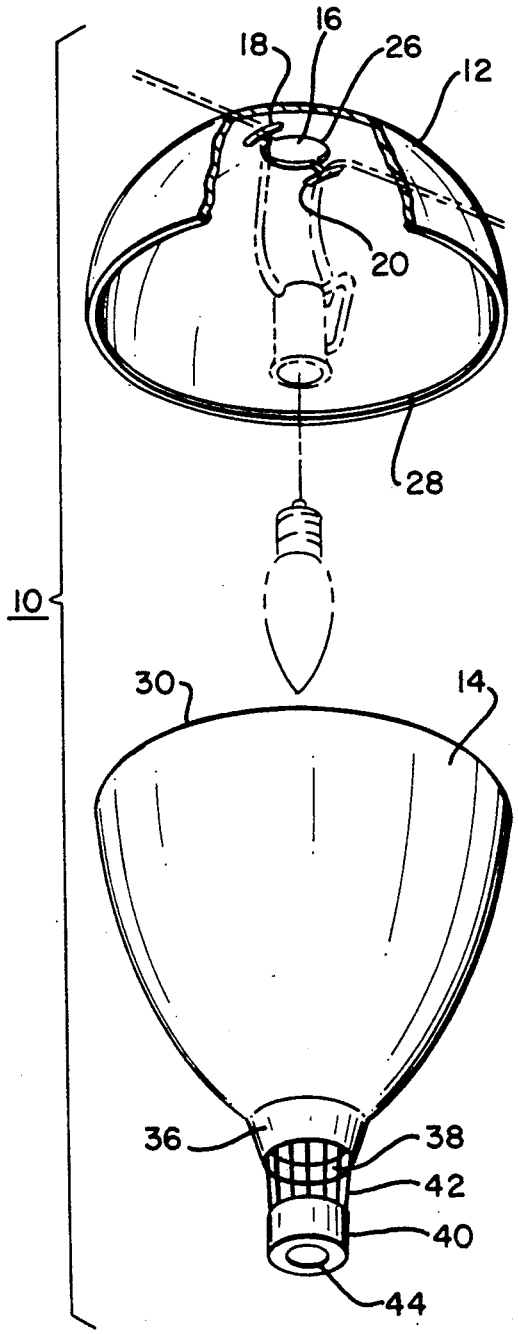
FIG. 2 is an exploded view of the decorative light shade of FIG. 1 wherein the upper and lower shade portions are separated to illustrate the manner in which the subject light shade is suspended from a decorative light string, and also showing the orientation of a decorative bulb socket assembly (in phantom) as installed within the subject decorative light shade.
Figure 3:
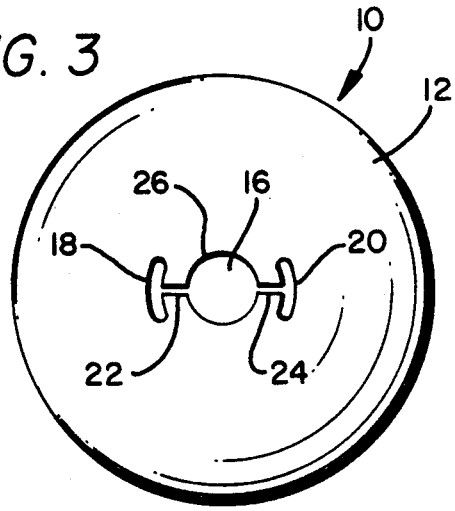
FIG. 3 is a plan view of the upper portion of the decorative light shade of the invention as shown in FIG. 1.

Referring to FIGS. 2 and 3, upper section 12 of decorative shade assembly 10 is further adapted to receive, engage and be supported by a conventional, commercially available decorative light string such as, for example, comprising a plurality of C7 or C9 size decorative bulb and socket assemblies joined by a common electrical conductor to a socket or other electrical power source. Upper section 12 preferably comprises a centrally disposed aperture 16 bounded by walls 26; arcuate slots 18, 20; and transverse passages 22, 24 communicating therebetween. The diameter of aperture 16 is desirably large enough to admit at least the socket portion of a decorative bulb and socket assembly as shown in exploded phantom outline in FIG. 2.

According to one embodiment of the invention, aperture 16 has a diameter sufficient to receive the socket portion, but not the bulb portion, of a decorative bulb and socket assembly. With this embodiment of the invention, the socket is desirably inserted downward through aperture 16 of upper section 12, and the bulb is then threaded into the socket. The relatively larger diameter of the bulb prevents the socket from being pulled backward through aperture 16 until the bulb is removed.

The electrical wires connected to the socket are desirably pulled from aperture 16 through transverse passages 22, 24, respectively, into arcuate slots 18, 20. The narrow dimension of transverse passages 22, 24 will preferably be such that frictional contact is exerted against the electrical cord as it is pulled from aperture 16 through a transverse passage and into the respective arcuate slot. Arcuate slots 18, 20 are desirably wide enough so that the electrical cord can then be rotated 90° to help prevent it from being pulled back through transverse passages 22, 24. When apertures 16, transverse passages 22, 24, and arcuate slots 18, 20 are thus constructed, decorative shade assembly 10 will not become disengaged from the decorative light string without the reapplication of manual force to pull the electrical cord back through transverse passages 22, 24. This being the case, decorative shade assembly 10 will not exert pressure downward on the bulb portion of the decorative bulb and socket assembly in the situation where the bulb diameter is greater than the diameter of aperture 16 in upper section 12. According to another embodiment of the invention, aperture 16 of upper section 12 has a diameter greater than that of both the bulb and socket portions of the decorative bulb and socket assembly, thereby permitting the assembled bulb and socket unit to be inserted through aperture 16 during installation without the necessity for unthreading and rethreading the decorative bulb.

Referring again to FIGS. 1 and 2, upper section 12 and lower section 14 are desirably snapped into releasable engagement to complete the assembly of decorative shade assembly 10 of the invention. As noted above, depending upon the diameter of aperture 16 relative to the diameter of the decorative bulb to be used therewith, upper section 12 and lower section 14 can be snapped together either before or after upper section 12 is attached to a decorative light string.

Figure 4:
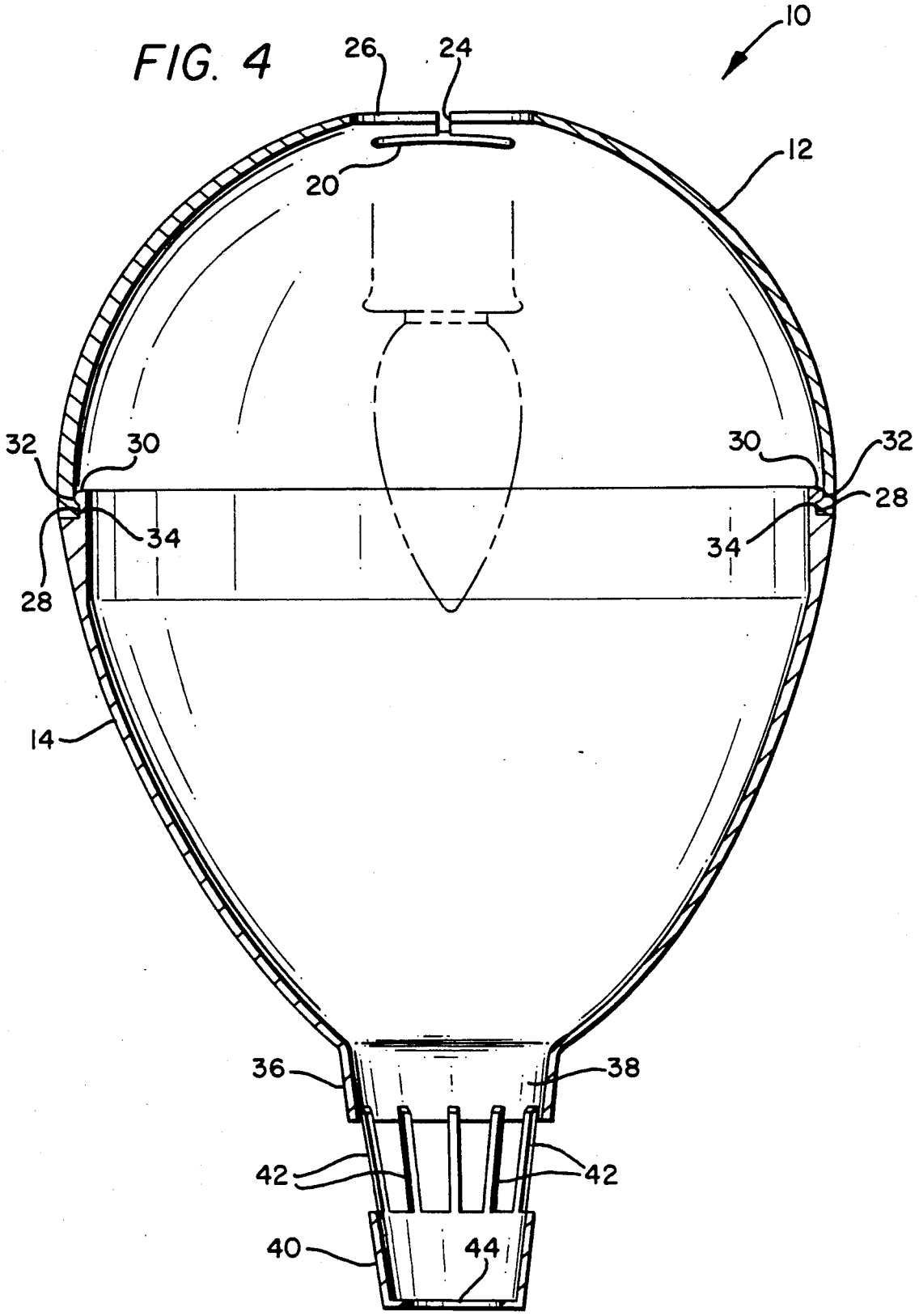
FIG. 4 is a sectional elevation view taken along line 4—4 of FIG. 1.

A preferred structure for use in releasably attaching upper section 12 and lower section 14 of decorative shade assembly 10 is shown in FIG. 4, which is a sectional elevational view taken along line 4—4 of FIG. 1. Referring to FIG. 4, upper section 12 preferably comprises annular lip 28 and annular groove 32. Lower section 14 preferably comprises annular lip 30 and annular groove 34. When constructed as shown in FIG. 4, annular lips 28, 30 are circumferentially aligned and forced past each other such that annular lip 28 snaps into annular groove 34 and annular lip 30 snaps into annular groove 32. Upper section 12 and lower section 14 are desirably molded from a polymeric material having sufficient flexibility that the two sections can be readily engaged and disengaged by the application of manual force without fitting so loosely that they will become unintentionally disengaged during ordinary use. Also, while FIG. 4 depicts a snap-lock engagement whereby the upwardly extending edge of lower section 14 is inserted into upper section 12, it will become apparent upon reading the disclosure that the converse orientation is also satisfactory for making the decorative shade assembly 10 of the invention.

According to the preferred embodiment of the invention as shown in FIGS. 1, 2 and 4, lower section 14 further comprises collar 36 defining downwardly directed opening 38. Decorative ring 40 comprising aperture 44 is suspended below and connected to collar 36 by a plurality of circumferentially spaced, integrally molded decorative ribs 42. Although collar 36, opening 38, decorative ring 40 and decorative ribs 42 help give decorative shade assembly 10 the decorative appearance of a hot air balloon, they also cooperate functionally to improve the distribution of light from decorative shade assembly 10 in the downward and radial direction. This functional aspect of the invention is particularly useful where decorative shade assembly 10 is utilized for lighting walkways, stairs, or other hazards. It will be appreciated upon reading this disclosure that similar functional advantages may be achieved by integrally molding other structural and appearance-related members into either of upper or lower sections 12, 14 in a similar manner. Thus, for example, a lattice or grid can be molded into the side of upper or lower sections 12, 14 to enhance the distribution of light and give the effect of a window in the side of decorative shade assembly 10 or, as another example, voids or apertures having a desired appearance feature can be molded into one of upper or lower sections 12, 14 to achieve such a combined functional and artistic effect.

Other alterations and modifications of the subject invention will become obvious to those of ordinary skill in the art upon reading this disclosure, and it is intended that the present invention be limited only by the broadest interpretation of the appended claims to which the inventor may be legally entitled.

I claim:

1. A decorative light shade assembly adapted for use with a decorative light string having a plurality of decorative bulb and socket assemblies connected by electrical conductors to a common source of electrical power, said decorative shade assembly comprising first and second shade sections molded from a polymeric resin, said first and second shade sections being adapted to be selectively engaged to and disengaged from each other by the application by manual force;

one of said shade sections further comprising means for receiving one of said decorative bulb and socket assemblies into the interior of said decorative shade assembly while said first and second shade sections are engaged and for frictionally engaging said decorative light string;

said means comprising an aperture in said shade section adapted to receive at least the socket portion of said decorative bulb and socket assembly, at least two slots in said shade section disposed on opposite sides of said aperture that are each adapted to receive an electrical conductor, and a transverse passageway in said shade section extending between each of said slots and said aperture, said transverse passageway being adapted to permit the movement of said electrical conductor through said transverse passageway by the application of manual force while simultaneously providing sufficient frictional resistance to the movement of said electrical conductor through said transverse passage that the weight of said decorative shade assembly is not sufficient to disengage said decorative shade assembly from said light string whenever said decorative shade assembly is suspended therefrom.

2. The decorative shade assembly of claim 1 wherein said means for engaging and disengaging said first and second shade sections by the application of manual force comprises a polymeric snap-lock joint.

3. The decorative shade assembly of claim 2 wherein each of said shade sections comprises an edge having a lip adapted to snap into releasable engagement with the other of said shade sections.

4. The decorative shade assembly of claim 3 wherein said edge and said lip extend circumferentially around one end of each said shade section.

5. The decorative shade assembly of claim 1 wherein at least one of said shade sections further comprises a molded aperture adapted to direct light outwardly through said shade section.

6. The decorative shade assembly of claim 5 wherein said aperture is disposed so as to direct light downwardly from said decorative shade assembly whenever said decorative shade assembly is suspended from said decorative light string and said decorative bulb and socket assemblies are energized from said electrical outlet or power source.

7. The decorative light shade assembly of claim 1 wherein said first and second shade sections are nestable when disengaged so as to occupy significantly less total volume when disengaged than when engaged.

8. The decorative light shade assembly of claim 1 wherein said first and second shade sections comprise a moldable thermoplastic polymer.

9. The decorative light shade assembly of claim 8 wherein said first and second shade sections are injection molded from said thermoplastic polymer.

10. The decorative light shade assembly of claim 1 wherein said shade sections are translucent.

* * * * *